US008240288B2

(12) United States Patent
Dilly

(10) Patent No.: US 8,240,288 B2
(45) Date of Patent: Aug. 14, 2012

(54) INTERNAL COMBUSTION ENGINE HAVING A MOTOR BRAKE ASSEMBLY

(75) Inventor: Hans-Werner Dilly, Dietenhofen (DE)

(73) Assignee: MAN Nutzfahrzeuge AG, Munich (DE)

( * ) Notice: Subject to any disclaimer, the term of this patent is extended or adjusted under 35 U.S.C. 154(b) by 131 days.

(21) Appl. No.: 12/896,492

(22) Filed: Oct. 1, 2010

(65) Prior Publication Data

US 2011/0079195 A1 Apr. 7, 2011

(30) Foreign Application Priority Data

Oct. 2, 2009 (DE) ..... 10 2009 048 104

(51) Int. Cl.
*F02D 13/04* (2006.01)

(52) U.S. Cl. ..... 123/321; 123/90.46; 123/90.15

(58) Field of Classification Search .... 123/90.15–90.18, 123/90.45, 90.46, 321
See application file for complete search history.

(56) References Cited

U.S. PATENT DOCUMENTS

| | | | | |
|---|---|---|---|---|
| 5,692,469 | A | 12/1997 | Rammer et al. | |
| 7,013,867 | B2 | 3/2006 | Rammer et al. | |
| 7,559,300 | B2 * | 7/2009 | Ruggiero | 123/90.12 |
| 8,065,987 | B2 * | 11/2011 | Yang | 123/321 |
| 8,146,566 | B2 * | 4/2012 | Lee et al. | 123/321 |
| 2002/0174849 | A1 | 11/2002 | Ruggiero et al. | |
| 2005/0000499 | A1 | 1/2005 | Ruggiero et al. | |
| 2005/0087170 | A1 | 4/2005 | Rammer et al. | |
| 2006/0081213 | A1 * | 4/2006 | Yang et al. | 123/321 |
| 2007/0095312 | A1 * | 5/2007 | Vanderpoel et al. | 123/90.16 |
| 2007/0144472 | A1 | 6/2007 | Yang | |
| 2010/0037854 | A1 * | 2/2010 | Yang | 123/321 |

FOREIGN PATENT DOCUMENTS

| | | |
|---|---|---|
| DE | 10 2007 014 248 | 9/2008 |
| EP | 0 736 672 | 10/1996 |
| EP | 1 526 257 | 4/2005 |
| WO | WO 2005/089274 | 9/2005 |
| WO | WO 2007/078309 | 7/2007 |

* cited by examiner

*Primary Examiner* — Erick Solis
(74) *Attorney, Agent, or Firm* — Cozen O'Connor

(57) ABSTRACT

An internal combustion engine includes an exhaust valve for removing exhaust gas from a combustion chamber and an engine braking device with a hydraulic valve control unit by which the exhaust valve is held in an intermediate open position when the engine braking device is actuated. The internal combustion engine includes a hydraulic valve lash compensation mechanism for the exhaust valve and a control channel formed between the hydraulic valve control unit and an oil feed channel for feeding oil to the hydraulic valve control unit which can be closed by a closure element to compensate for valve lash of the exhaust valve. A counter-holder is constructed as a piston-cylinder unit that forms a variable stop for a valve bridge cooperating with the valve lash compensation mechanism.

15 Claims, 2 Drawing Sheets

INTERNAL COMBUSTION ENGINE HAVING A MOTOR BRAKE ASSEMBLY

BACKGROUND OF THE INVENTION

1. Field of the Invention

The invention is directed to an internal combustion engine with an engine breaking device that is configured to maintain an exhaust valve in an intermediate position.

2. Description of the Related Art

An internal combustion engine of the type mentioned above is described in EP 1 526 257 A2. The engine braking device in this internal combustion engine is a combination of an engine exhaust brake and a compression release brake, also known as EVB (Exhaust Valve Brake). The hydraulic valve control unit is installed on one side in a valve bridge which actuates two exhaust valves simultaneously. The supply of oil to the valve control unit is carried out by the existing oil circuit in the internal combustion engine. Separate adjustment screws are provided for compensating valve lash in the exhaust valves and are used to adjust the valve lash when assembling the engine or afterwards at regular servicing intervals. This is uneconomical. In the event that excessive valve lash is unintentionally adjusted by assembly or servicing personnel, chattering noises will result between the rocker arm and valve bridge and there is a risk that the valve train will be damaged. Further, the exhaust valves do not open sufficiently, so that a complete exchange of gas is not ensured. If insufficient valve lash is adjusted, there is a risk that the valves will not close completely in the hot state and will accordingly burn out.

SUMMARY OF THE INVENTION

It is an object of the invention to provide an internal combustion engine of the type mentioned above that enables a safe and reliable operation with the least possible expenditure on assembly and servicing.

The internal combustion engine according to one embodiment of the invention comprises a hydraulic valve lash compensation mechanism for the exhaust valve, which hydraulic valve lash compensation mechanism is arranged between the rocker arm and the valve bridge and is connected to the existing oil circuit for supplying oil. The hydraulic valve control unit is supplied with oil through the control channel. The control channel can be closed by the closure element to adjust the valve lash of the exhaust valve so that when compensating valve lash the hydraulic valve control unit is not supplied with oil and the valve bridge and exhaust valve are located in a defined position. The hydraulic valve control unit is accordingly decoupled from the oil circuit during valve lash compensation. Owing to the fact that the backstop or counter-holder is constructed as a hydraulic piston-cylinder unit, the valve bridge is provided with a variable stop that automatically adapts to the position of the valve lash compensation mechanism. A manual adjustment of the stop or of the clearance of the counter-holder relative to the valve bridge during assembly or at regular servicing intervals is not required.

Accordingly, the internal combustion engine according to one embodiment of the invention has the valve control unit required for achieving an engine braking force action as well as a compensation mechanism that which automatically performs valve lash adjustment. A time-consuming, costly and error-prone regular manual adjustment is obviated. Accordingly, compared to previous internal combustion engines outfitted with an engine braking device, the internal combustion engine according to the invention offers the added functionality of automatic valve lash adjustment for a safer, more efficient assembly and operation. In particular, the automatic valve lash adjustment minimizes chattering noise in the exhaust valve and prevents damage to the valve train due to insufficient valve lash adjustment. Further, there is no need for the automatic valve lash compensation mechanism to bridge over valve lash during operation of the internal combustion engine, so that the control times of the exhaust valve can be adhered to exactly and the exhaust gas behavior of the internal combustion engine is optimized.

Internal combustion engines without a hydraulic valve lash compensation mechanism can be retrofitted economically in that the valve control unit and valve lash compensation mechanism are connected to the existing oil circuit.

One embodiment of the invention economizes on space and makes it possible to retrofit internal combustion engines without a hydraulic valve lash compensation mechanism simply by replacing the rocker arm, valve bridge and counter-holder and by integrating the valve lash compensation mechanism in the rocker arm. The stability of the valve bridge is not impaired by integrating the valve lash compensation mechanism in the rocker arm.

The compensation piston acting as a contact stud cooperates with the rocker arm and valve bridge for actuating the latter. Accordingly, by displacing the compensation piston relative to the rocker arm, a length adjustment of the contact stud is carried out corresponding to the valve lash to be compensated.

The valve lash compensation mechanism and the valve control unit are quickly supplied with a sufficient amount of oil.

A connection channel decouples the oil supply of the valve control unit from that of the valve lash compensation mechanism. The connection channel preferably runs between the oil reservoir space and the control channel.

One embodiment of the invention economizes on space and makes it possible to retrofit internal combustion engines without a hydraulic valve lash compensation mechanism simply by replacing the valve bridge and counter-holder and by integrating the valve lash compensation mechanism in the valve bridge.

A reliable closing of the control channel is ensured. Since the control piston is in its retracted home position when the engine braking device is not actuated, the control piston can close the control channel and therefore forms the closure element. In this way, a decoupling of the valve control unit from the oil circuit is achieved without additional expenditure on construction so that the valve bridge and exhaust valve are in a defined position when compensating for valve lash.

A check valve prevents the extended control piston from retracting when the force generated by the oil pressure on the control piston is not sufficient for this purpose. Therefore, the exhaust valve is reliably blocked in the intermediate open position.

A counter-holder is supplied with oil in a simple manner so that the first counter-holder piston forms an absolutely fixed stop for the valve bridge in engine braking operation. In the intermediate open position of the exhaust valve, oil flows through the supply channel into the counter-holder spaces so that the position of the first counter-holder piston resting against the valve bridge is fixed.

A valve bridge prevents air from becoming trapped in the counter-holder spaces because the second counter-holder piston dips into the recess which is filled with oil. Therefore, compressible air cushions cannot form in the counter-holder spaces so that a fixed stop is ensured for the valve bridge.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Other features, advantages and details of the invention are indicated in the following description of several embodiment examples with reference to the drawings. In the drawings.

DETAILED DESCRIPTION OF THE PRESENTLY PREFERRED EMBODIMENTS

Figure 1:
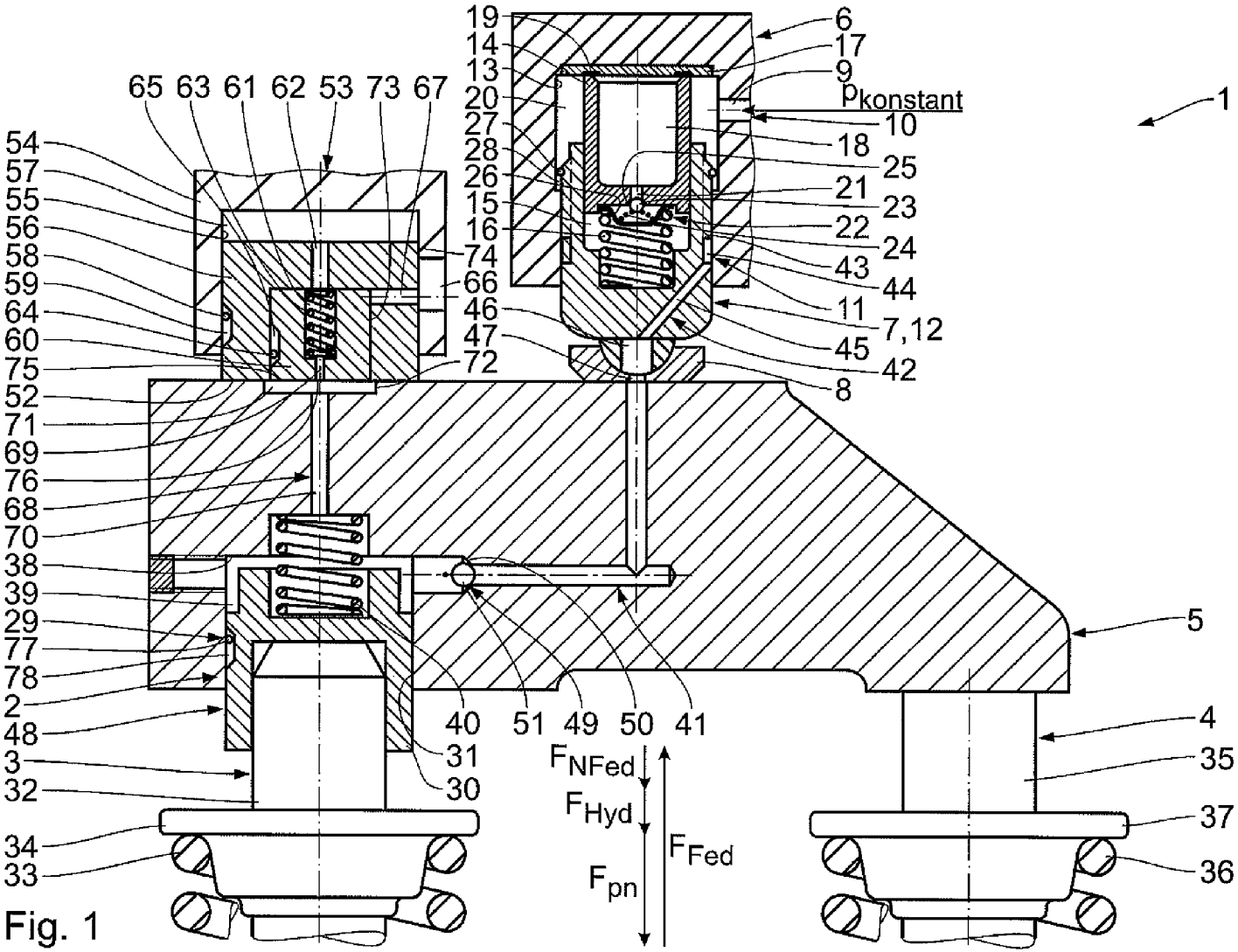
FIG. 1 is a cross-sectional view through a valve control unit and valve lash compensation mechanism according to a first embodiment example.

A first embodiment of the invention will be described in the following with reference to FIG. 1. An internal combustion engine 1 with an engine braking device 2 has a plurality of cylinders, not shown in FIG. 1, which define a combustion chamber. Air or an air-fuel mixture can be supplied to each of these combustion chambers by at least one inlet valve. Further, two exhaust valves 3 and 4, through which exhaust gas can be carried off in an exhaust gas duct, are associated with each combustion chamber. The exhaust valves 3 and 4 can be mechanically controlled and actuated by a common valve bridge 5. The valve bridge 5 is part of a connection mechanism that connects the exhaust valves 3 and 4 to a camshaft, not shown in FIG. 1, of the internal combustion engine 1. The connection mechanism comprises a pivotably mounted rocker arm 6 that acts on the valve bridge 5 via a contact stud 7. To this end, the contact stud 7 is provided at its free end with a support cup 8 which is articulated in the manner of a ball joint. An oil feed channel 9 of an oil circuit 10 of the internal combustion engine 1 which is provided for lubrication as well as for hydraulic control extends inside the rocker arm 6. The oil that is guided in this oil feed channel 9 has approximately the same oil pressure $p_{konstant}$ during operation.

The contact stud 7 is part of a hydraulic valve lash compensation mechanism 11 which is constructed as a piston-cylinder unit and which is arranged between the rocker arm 6 and the valve bridge 5. The valve lash compensation mechanism 11 serves to automatically compensate the valve lash of the exhaust valves 3 and 4. The valve lash compensation mechanism 11 is integrated in the rocker arm 6. The contact stud 7 forms a compensation piston 12 which is U-shaped in longitudinal section and which is guided so as to be movable axially in a first cylinder bore 13 formed in the rocker arm 6 and acting as a cylinder. The compensation piston 12 together with a supporting piston 14 defines a compensation space 15. A first reset spring 16 is arranged in this compensation space 15 between the compensation piston 12 and the supporting piston 14.

The supporting piston 14 is U-shaped in longitudinal section and rests against a supporting plate 17 whose end is supported in the cylinder bore 13 of the rocker arm 6. The supporting piston 14 is supported in the U-shaped compensation piston 12 and guided therein so as to be axially movable. Owing to its U-shaped construction, the supporting piston 14 together with the supporting plate 17 defines an inner oil reservoir space 18 which communicates with an annular, outer oil reservoir space 20 via channels 19 formed in the supporting plate 17. The outer oil reservoir space 20 is defined substantially by the rocker arm 6, the compensation piston 12, the supporting piston 14, and the supporting plate 17. The oil feed channel 9 opens into the outer oil reservoir space 20.

The valve lash compensation mechanism 11 is connected to the oil circuit 10. The supporting piston 14 has a central oil supply channel 21 connecting the inner oil reservoir space 18 with the compensation space 15. A first check valve 22 (non-return valve) is provided at an end of the oil supply channel 21 facing the compensation space 15. The ball 23 of the check valve 22 is pressed into a ball seat 25 of the oil supply channel 21 by a check valve spring 24. The check valve spring 24 is supported against a supporting plate 26 which is held between the supporting piston 14 and the reset spring 16. The movement of the compensation piston 12 is limited by first limiting pins 27, which stop against an annular collar 28, in a maximum extended position of the compensation piston 12.

The engine braking device 2 of the internal combustion engine 1 is an EVB type and, in addition to a throttle element in the exhaust gas duct and a central control unit for every cylinder (neither the throttle element nor the central control unit is shown in FIG. 1), comprises a hydraulic valve control unit 29 constructed as a piston-cylinder unit. The valve control unit 29 has a control piston 30 guided to be movable axially in a second cylinder bore 31 formed in the valve bridge 5 that acts as a cylinder. The control piston 30 is substantially H-shaped in longitudinal section and is supported at the top end of a shaft 32 of the exhaust valve 3. The exhaust valve 3 is mounted such that its shaft 32 is movable axially in a cylinder head and is acted upon in the closing direction by a determined preloading force by a closing spring 33. The closing spring 33 is tensioned between the cylinder head and a spring plate 34. The closing force of the closing spring 33 is designated by $F_{Fed}$.

The valve control unit 29 is arranged between the exhaust valve 3 and the valve bridge 5 and accordingly, in engine braking operation, cooperates only with exhaust valve 3 but not with exhaust valve 4. Exhaust valve 4 is mounted such that its shaft 35 is movable axially in the cylinder head corresponding to exhaust valve 3 and is acted upon in the closing direction by a corresponding preloading force by a closing spring 36. The closing spring 36 is tensioned between the cylinder head and a spring plate 37.

In the position of the control piston 30 shown in FIG. 1, a control space 39 is formed between a boundary surface 38 and the control piston 30. A second reset spring 40 which contacts the boundary surface 38 and the control piston 30 and presses the latter against the shaft 32 is arranged in the control space 39. Accordingly, the spring force of the reset spring 40 acts against the closing force $F_{Fed}$ of the closing spring 33 and is designated hereinafter by $F_{NFed}$.

A control channel 41 is formed inside the valve bridge 5 and a connection channel 42 is formed in the compensation piston 12 are provided for the oil feed to the valve control unit 29 and connect the control space 39 to the oil feed channel 9 and, therefore, connect the valve lash compensation mechanism 11 to the oil circuit 10. The connection channel 42 is formed in the compensation piston 12 such that the oil feed channel 9 is connected with the control channel 41 while bypassing the compensation space 15. For this purpose, starting from the oil reservoir space 20, the connection channel 42 has at least a first channel portion 43 which extends in axial direction circumferentially and connects the oil reservoir space 20 to an annular second channel portion 44 disposed at the circumference. Starting from the second channel portion 44, a third channel portion 45 extends in direction of the center longitudinal axis of the compensation piston 12 which produces the connection to a central fourth channel portion 46 extending in axial direction. A fifth channel portion 47 is arranged concentric to the fourth channel portion 46 is formed in the supporting cup 8.

The control channel 41 opens into the control space 39 such that the control piston 30 forms a closure element 48 for the control channel 41 at its top dead center. A second check valve 49 having a ball 51 that can be received in a ball seat 50 is arranged in the control channel 41. The check valve 49 is oriented in such a way that it closes the control channel 41 when oil flows in direction of the oil feed channel 9. A limiting pin 77 extends in a lateral piston recess 78 of the control piston 30 to limit the movement of the control piston 30.

A counter-holder 53 is provided so as to furnish a stop 52 for the valve bridge 5. The counter-holder 53 is constructed as a hydraulic piston-cylinder unit and has a counter-holder base body 54 with a third cylinder bore 55 in which a first counter-holder piston 56 is guided axially. In the position of the first counter-holder piston 56 shown in FIG. 1, a first counter-holder space 57 is formed between the counter-holder piston 56 and the counter-holder base body 54. The movement of the first counter-holder piston 56 is limited by a limiting pin 58 which is arranged in a recess 59 of the counter-holder piston 56.

The first counter-holder piston 56 is U-shaped in longitudinal section and serves as a cylinder for a second counter-holder piston 60 guided in the first counter-holder piston 56 so as to be movable axially. Together with the first counter-holder piston 56, the second counter-holder piston 60, which is U-shaped in longitudinal section, defines a second counter-holder space 61 which is connected to the first counter-holder space 57 by a first axial through-hole 62 formed in the first counter-holder piston 56. A third reset spring 63 contacts the counter-holder pistons 56 and 60 is arranged in the second counter-holder space 61. The movement of the second counter-holder piston 60 is limited by a limiting pin 64 arranged in a recess 65 of the first counter-holder piston 56.

The counter-holder base body 54 has a first radial through-hole 66 dimensioned such that a second radial through-hole 67 formed in the first counter-holder piston 56 communicates with the first radial through-hole 66 over the entire piston stroke of the first counter-holder piston 56. The second radial through-hole 67 is arranged in the first counter-holder piston 56 in such a way that the second counter-holder piston 60 closes it in a completely retracted position and releases it in an extended position.

The first counter-holder space 57 is connected by a supply channel 68 to the control space 39 and to the oil circuit 10. The second counter-holder piston 60 has a second axial through-hole 69 aligned with a corresponding bore hole 70 in the valve bridge 5 to form the supply channel 68. The bore hole 70 opens into a recess 71 formed for the second counter-holder piston 60 to dip into the valve bridge 5. The recess 71 is part of the supply channel 68. The outer contour 72 of the recess 71 is formed such that it encloses the outer contour 73 of the second counter-holder piston 60, i.e., so that the second counter-holder piston 60 can dip into the recess 71, and is enclosed by the outer contour 74 of the first counter-holder piston 56, i.e., so that the first counter-holder piston 56 cannot dip into the recess 71. When the first counter-holder piston 56 is lifted from the valve bridge 5, the supply channel 68 is interrupted. In this state, the recess 71 forms a first control aperture 75 and the second axial through-hole 69 forms a second control aperture 76.

The operation of the engine braking device 2 and valve lash compensation mechanism 11 will be described in more detail in the following.

Engine braking operation will be discussed first. When the engine braking device 2 is actuated, the throttle element in the exhaust gas duct is moved into the throttle position so that exhaust gases are backed up in the exhaust gas duct between the exhaust valve opening of the cylinder and the throttle element. This back pressure in the exhaust gas duct together with the compression wave of the opening exhaust valves of the adjacent cylinders causes an intermediate opening of the exhaust valve 3 which occurs during the compression stroke and the expansion stroke of every Otto cycle of the internal combustion engine 1. The exhaust valve 3 first jumps when the valve bridge 5 is at top dead center. Because of the pressure ratios prevailing in the combustion chamber of the cylinder and in the exhaust gas duct, a pneumatic force $F_{pn}$ results which opposes the closing force $F_{Fed}$ of the closing spring 33 and the above-mentioned intermediate opening of the exhaust valve 3. The spring force $F_{NFed}$ of the reset spring 40 moves the control piston 30 up to the exhaust valve 3 and reinforces the intermediate opening of the exhaust valve 3. The moving up of the control piston 30 causes an increase in the volume of the control space 39. At the same time, the control piston 30 acting as a closure element 48 releases the control channel 41 so that the oil required for the movement is made available to the control piston 30 via the control channel 41. Because of the vacuum pressure occurring in the control space 39, oil flows through the oil feed channel 9 and the oil reservoir channels 18 and 20, connection channel 42, and the control channel 41 into the control space 39 so that a hydraulic force $F_{Hyd}$ acts on the control piston 30 and reinforces the reset spring 40.

Further, oil flows from the control space 39 via the supply channel 68 into the counter-holder spaces 57 and 61. Due to the fact that the second counter-holder piston 60 is completely extended as a result of the reset spring 63, the second counter-holder piston 60 releases the second radial through-hole 67 so that air and excess oil located in the counter-holder spaces 57 and 61 can escape through the radial through-holes 66 and 67. When the control piston 30 is pushed in direction of top dead center again because of the closing force $F_{Fed}$ of the closing spring 33, the second counter-holder piston 60 moves in direction of its top dead center and strikes against the first counter-holder piston 56 so that the second radial through-hole 67 is closed. Therefore, the oil cannot escape from the control space 39 and counter-holder spaces 57 and 61 because of the check valve 49 and the second counter-holder piston 60, so that the control piston 30 is held in position against the closing force $F_{Fed}$ of the closing spring 33. The first counter-holder piston 56 acts as a fixed stop 52 for the valve bridge 5 because the first counter-holder space 57 is filled with compressed oil. Accordingly, the control piston 30 is hydraulically blocked in the valve bridge 5 so that the exhaust valve 3, which is mechanically coupled with the control piston 30, is held in the intermediate open position. Therefore, the exhaust valve 3 remains in the intermediate open position during the second stroke (compression stroke) and the following third stroke (expansion stroke) so that the desired engine braking effect takes place.

At the end of the third stroke, the rocker arm 6 loads the valve bridge 5 again due to the camshaft control in order to bring the exhaust valves 3 and 4 into the completely open position provided during the fourth stroke. The valve bridge 5 moves away from the first counter-holder piston 56 due to the load exerted by the rocker arm 6 so that contact is broken off between it and the valve bridge 5, and the control apertures 75, 76 open. Before contact is broken off, oil is forced from space 39 into the third cylinder bore 55 so that the piston 58 moves gradually downward along with it, which is why no spring is needed in the third cylinder bore 55 to carry this out. After contact is interrupted, the oil located in the control space 39 can flow out into the area of the cylinder cover via the control aperture 75. The hydraulic blocking of the control piston 30 is canceled in this way. The flow of oil from the control space 39 is also supported in that the control piston 30 is forced back into its top dead center by the closing force $F_{Fed}$ of the closing spring 33. Further, the check valve 49 closes the control channel 41 during the return movement of the control piston 30. The oil located in the counter-holder spaces 57 and 61 can flow out into the area of the cylinder cover via the control aperture 76. The second counter-holder piston 60 is moved into its fully extended position again by the reset spring 63. As long as the control piston 30 does not yet completely close the control channel 41, oil flows out of the oil reservoir spaces 18 and 20 via the control space 39 and control aperture 75 into the area of the cylinder cover. The flowing off of oil has no effect on the position of the compensation piston 12 because the oil feed to the control space 39 is decoupled from the oil feed to the compensation space 15.

During the return lift of the rocker arm 6, the second counter-holder piston 60 dips into the oil-filled recess 71 until the first counter-holder piston 56 strikes against the valve bridge 5. The successive dipping into the oil prevents air from becoming trapped in the counter-holder spaces 57 and 61. The first counter-holder piston 56 adapts to the position of the valve bridge 5, and excess oil can escape from the first counter-holder space 57 via the first axial through-hole 62 and radial through-holes 66 and 67. During the return lift, the control piston 30 remains at top dead center and continues to close the control channel 41. The valve bridge 5 and the exhaust valves 3 and 4 are accordingly in a defined position so that the valve lash compensation mechanism 11 can compensate for valve lash. The spring force of the reset spring 16 positions the compensation piston 12 in such a way that the valve lash is adjusted to zero. Due to the drop in pressure occurring in the compensation space 15, oil flows from the oil reservoir space 15 into the compensation space 15 via the check valve 22.

Normally fueled engine operation will be described in the following. In normally fueled engine operation, the throttle element in the exhaust gas duct stays in the open position. Since the exhaust valve 3 does not jump into an intermediate open position in normally fueled engine operation due to the closing force $F_{Fed}$ of the closing spring 33, the control piston 30 remains in top dead center from the first stroke to the fourth stroke. Accordingly, the control channel 41 is constantly closed. Due to the fact that no spring is required in the third cylinder bore 55, as was described above, the first counter-holder piston 56 is prevented from striking the stop 52.

At the end of the third stroke, the rocker arm 6 loads the valve bridge 5 due to the camshaft control so as to move the exhaust valves 3 and 4 into the completely open position provided during the fourth stroke. The compensation piston 12 compresses the oil located in the compensation space 15. The compensation space 15 is sealed in direction of the oil supply channel 21 by the check valve 22. Due to the exactly fitting surfaces of the compensation piston 12 and control piston 14, no oil can escape from the compensation space 15 and the oil reservoir spaces 18 and 20 so that the force exerted by the rocker arm 6 on the compensation piston 12 is accordingly transmitted to the valve bridge 5 via the oil cushion. The valve bridge 5 moves away from the counter-holder 53 due to the load exerted by the rocker arm 6 so that the exhaust valves 3 and 4 are opened.

During the return lift of the rocker arm 6, the second counter-holder piston 60 dips into the oil-filled recess 71 until the first counter-holder piston 56 strikes against the valve bridge 5. The first counter-holder piston 56 adapts to the position of the valve bridge 5 corresponding to the engine braking operation. Since the control piston 30 is top dead center and closes the control channel 41, the valve bridge 5 is in a defined position so that the valve lash compensation mechanism 11 can compensate for valve lash. The reset spring 16 positions the compensation piston 12 in such a way that the valve lash is adjusted to zero. Owing to the drop in pressure in the compensation space 15, oil flows from the oil reservoir space 18 via the check valve 22.

There is no adjustment of valve lash in the internal combustion engine 1 during engine assembly or subsequent operation. Valve lash is compensated automatically by the valve lash compensation mechanism 11. Owing to the fact that the control channel 41 can be closed by the control piston 30, the valve control unit 29 can be decoupled from the oil circuit 10 so that the exhaust valve 3 and the valve bridge 5 have a defined position for the compensation of valve lash. In particular, an automatic compensation of the thermal expansion of the exhaust valves 3 and 4 is also carried out. Since there is substantially no clearance to be bridged, the theoretical control times can be adhered to exactly. This is also beneficial for the exhaust gas values. Further, the compensation of valve lash reduces noise in the internal combustion engine 1.

A second embodiment example of the invention will be described in the following with reference to FIG. 2. Parts constructed identically to those in the first embodiment example have the same reference numbers, and reference is had to the description of the first embodiment example in this respect. Parts having a different construction have the same reference numbers with an 'a' appended to them. The valve lash compensation mechanism **11*a* is arranged between the rocker arm 6*a* and the valve bridge 5*a* and is integrated in the valve bridge 5*a*. For this purpose, the first cylinder bore 13*a* is formed in the valve bridge 5*a*. The compensation piston 12*a* which is U-shaped in longitudinal section is guided therein so as to be movable axially. The valve bridge 5*a* and the compensation piston 12*a* define the compensation space 15*a* in which the first reset spring 16*a* is arranged. The oil supply channel 21*a* is formed in the compensation piston 12*a* and is connected to the oil feed channel 9 via the connection channel 42*a*. The control channel 41 extends from the compensation space 15 to the control space 39**.

Due to the pressure drop occurring in the control space 39 during the intermediate opening of the exhaust valve 3, oil flows through the oil supply channel **21*a*, the compensation space 15*a* and the control channel 41 into the control space 39. The control piston 30 is hydraulically blocked in the valve bridge 5*a* in the manner described above so that the exhaust valve 3, which is mechanically coupled with the control piston 30, is held in the intermediate open position. When the first counter-holder piston 56 is lifted from the valve bridge 5*a*, oil can flow out of the compensation space 15*a* into the area of the cylinder cover via the control space 39 and the control aperture 75 as long as the control piston 30 does not yet completely close the control channel 41 so that the compensation piston 12*a* is pushed in direction of its bottom dead center. During the return lift, the control piston 30 remains at top dead center and continues to close the control channel 41**.

The valve bridge 5*a* and the exhaust valves 3 and 4 are accordingly in a defined position so that the valve lash compensation mechanism 11*a* can compensate for valve lash. The spring force of the reset spring 16*a* positions the compensation piston 12*a* in such a way that the valve lash is adjusted to zero. Due to the drop in pressure occurring in the compensation space 15*a*, oil flows into the compensation space 15*a* via the check valve 22. Reference is had to the preceding embodiment example with respect to further operation.

Figure 2:
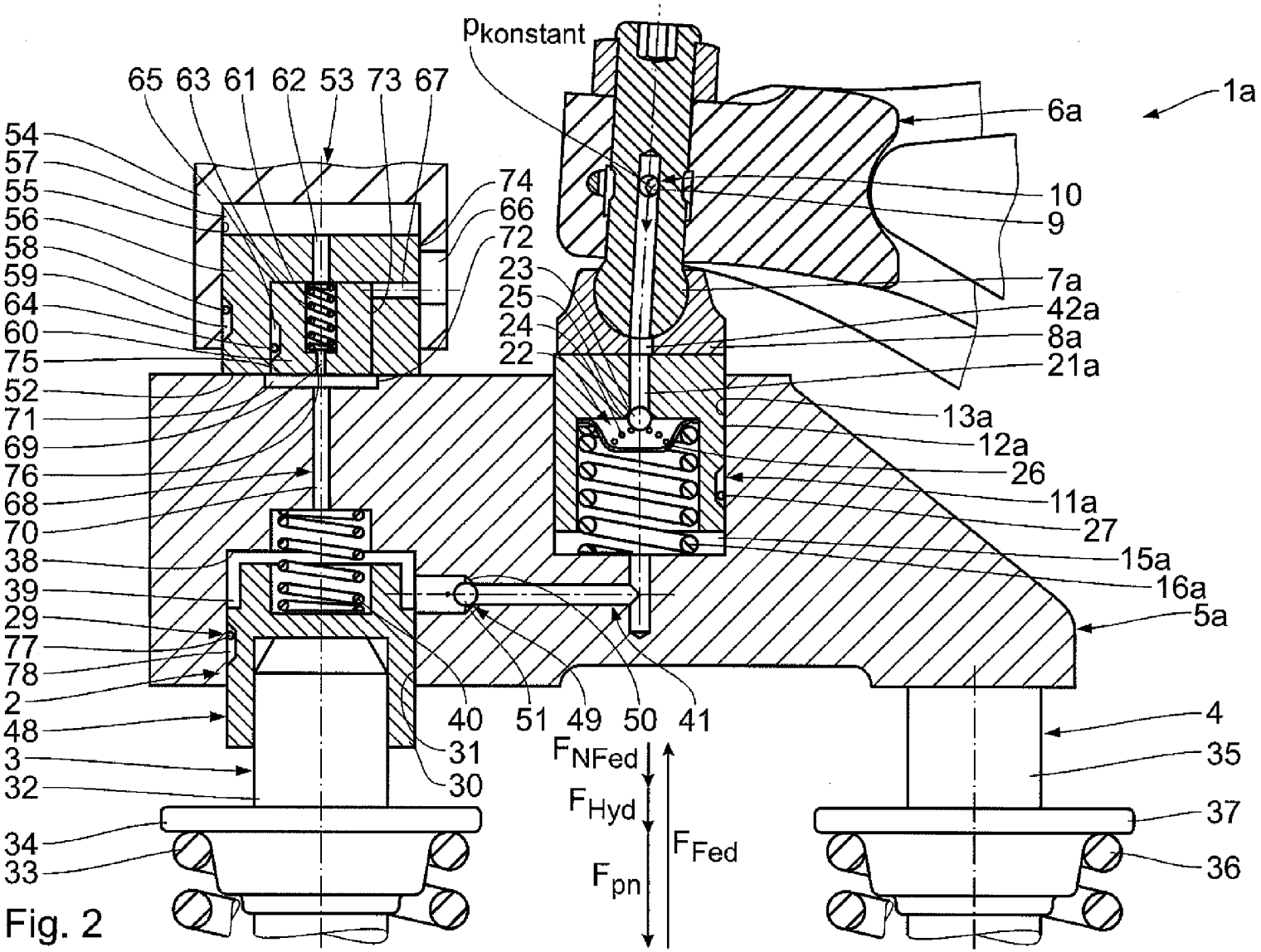
FIG. 2 is a cross-sectional view through a valve control unit and valve lash compensation mechanism according to a second embodiment example.

In conclusion, it will be noted that there is a basic difference between the examples shown in FIGS. 1 and 2. Since the oil for the EVB in the example according to FIG. 2 must flow through the element for valve lash compensation, valve lash compensation is not possible during braking operation in this variant. Rather, the compensation piston 12*a* gradually moves into its bottom stop while the oil is received by the control space 39. In the example according to FIG. 1, this is not possible because of the parallel oil supply. On the other hand, the series connection according to FIG. 2 reliably prevents a pumping up of the element for valve lash compensation in the event of a jumping of the exhaust valve 4.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. An internal combustion engine comprising:

an exhaust valve configured to removing exhaust gas from a combustion chamber of the internal combustion engine;

a valve bridge configured to support the exhaust valve;

a rocker arm configured to displace the valve bridge;

an oil feed channel of an oil circuit configured to supply oil;

an engine braking device that comprises a hydraulic valve control unit arranged between the exhaust valve and the valve bridge, is connected to the oil feed channel by which the exhaust valve can be held in an intermediate open position when the engine braking device is actuated;

a counter-holder constructed as a hydraulic piston-cylinder unit configured to furnish a stop for the valve bridge;

a hydraulic valve lash compensation mechanism for the exhaust valve arranged between the rocker arm and the valve bridge and connected to the oil feed channel for supplying oil; and a control channel connected to the oil feed channel configured to feed oil to the hydraulic valve control unit that is closeable by a closure element to compensate for valve lash of the exhaust valve, wherein the counter-holder is configured to adapt the stop to a position of the valve lash compensation mechanism.

2. The internal combustion engine according to claim 1, wherein the valve lash compensation mechanism comprises:

a compensation piston guided in a first cylinder bore;

a compensation space defined by the compensation piston;

a first reset spring arranged in the compensation space;

an oil supply channel that opens into the compensation space; and a first check valve configured to close the oil supply channel.

3. The internal combustion engine according to claim 2, wherein the valve lash compensation mechanism is integrated in the rocker arm.

4. The internal combustion engine according to claim 3, wherein the first cylinder bore is formed in the rocker arm and the compensation piston is axially guided therein, the compensation piston is U-shaped in longitudinal section, a supporting piston supported at the rocker arm and is axially guided in the compensation piston, the supporting piston and the compensation piston define the compensation space, and the oil supply channel is formed in the supporting piston.

5. The internal combustion engine according to claim 4, wherein the supporting piston is U-shaped in longitudinal section and forms an oil reservoir space.

6. The internal combustion engine according to claim 2, further comprising a connection channel arranged in the compensation piston that connects the oil feed channel to the control channel while bypassing the compensation space.

7. The internal combustion engine according to claim 1, wherein the valve lash compensation mechanism is integrated in the valve bridge.

8. The internal combustion engine according to claim 7, wherein a first cylinder bore is formed in the valve bridge and the compensation piston is axially guided therein, the compensation piston and the valve bridge define the compensation space, and the oil supply channel is formed in the compensation piston.

9. The internal combustion engine according to claim 1, wherein the valve control unit comprises:

a control piston guided in a second cylinder bore;

a control space defined by the control piston; and a second reset spring arranged in the control space.

10. The internal combustion engine according to claim 9, wherein the valve control unit is integrated in the valve bridge and the control channel is formed in the valve bridge.

11. The internal combustion engine according to claim 10, wherein the control channel opens into the control space such that the control piston forms a closure element.

12. The internal combustion engine according to one of claim 1, further comprising a second check valve arranged in the control channel.

13. The internal combustion engine according to one of claim 1, wherein the counter-holder comprises:

a counter-holder base body having a third cylinder bore forming a first counter-holder space and a first radial through-hole;

a counter-holder piston guided in the third cylinder bore which, together with the counter-holder base body, defines the first counter-holder space that is U-shaped in longitudinal section and forms a second counter-holder space having a first axial through-hole connecting the counter-holder space, and a second radial through-hole at least partially overlapping the first radial through-hole;

a second counter-holder piston guided in the first counter-holder piston which, together with the first counter-holder base body, defines the second counter-holder space has a second axial through-hole opening into the second counter-holder space; and a third reset spring arranged in the second counter-holder space.

14. The internal combustion engine according to claim 13, wherein the first and second axial through-holes comprise a supply channel connecting the control space to the first counter-holder space.

15. The internal combustion engine according to claim 14, wherein the valve bridge comprises a recess having an outer contour for the second counter-holder piston, which recess is part of the supply channel, the outer contour enclosing an outer contour of the second counter-holder piston which is enclosed by an outer contour of the first counter-holder piston.

* * * * *